United States Patent [19]

Block

[11] 4,245,484

[45] Jan. 20, 1981

[54] EARRING

[75] Inventor: Alvin Block, Bedford, N.Y.

[73] Assignee: Intimate Jewels Inc., Katonah, N.Y.

[21] Appl. No.: 73,625

[22] Filed: Sep. 10, 1979

Related U.S. Application Data

[63] Continuation-in-part of Ser. No. 908,059, May 22, 1978, Pat. No. 4,170,118, and a continuation-in-part of Ser. No. 32,652, Apr. 23, 1979.

[51] Int. Cl.[3] ..... A44C 7/00

[52] U.S. Cl. ..... 63/12; 411/373; 411/521

[58] Field of Search ..... 63/12, 13; 85/36

[56] References Cited

U.S. PATENT DOCUMENTS

| | | | |
|---|---|---|---|
| 298,987 | 5/1884 | Krementz | 63/12 X |
| 335,100 | 2/1886 | Adams et al. | 63/12 X |
| 439,457 | 10/1890 | Whittemore et al. | 63/12 X |
| 733,263 | 7/1903 | Nordt | 63/12 |
| 2,373,002 | 4/1945 | Armstrong | 63/12 X |
| 2,713,863 | 7/1955 | Handerson | 63/12 X |
| 2,834,235 | 5/1958 | Sarti | 85/36 X |
| 2,882,702 | 4/1959 | Goldberg et al. | 85/36 X |
| 2,913,950 | 11/1959 | Tinnerman | 85/36 |
| 3,563,056 | 2/1971 | Noel | 63/12 |

FOREIGN PATENT DOCUMENTS

| | | | |
|---|---|---|---|
| 295468 | 3/1954 | Switzerland | 63/12 |
| 883010 | 11/1961 | United Kingdom | 85/36 |

*Primary Examiner*—F. Barry Shay

*Attorney, Agent, or Firm*—Kirschstein, Kirschstein, Ottinger & Cobrin

[57] ABSTRACT

An improvement in post-type earrings, which are earrings connected to a human ear by a rigid slender short rod or post which extends from an ornament, and is rectilinear and cylindrical. The post is threaded at the end opposite to the ornament, and a clutch having a conical configuration formed by a concave base and a plurality of radial springy fingers is provided. The clutch is pushed onto the post, whereby the tips of the fingers engage the convolutions of the helical threading, and the clutch may only be removed by unscrewing it off of the post. The present clutch configuration features a concave base for self-locating of the post; an octagonal base perimeter for facilitating grip and unscrewing; convex rounded tips on the fingers; a center longitudinal ridge on each finger for increased strength and less weight; lateral end ridges adjacent the finger tips to prevent degradation or bending of the tips; and lateral base ridges on each finger which improve flexibility.

8 Claims, 4 Drawing Figures

FIG.1
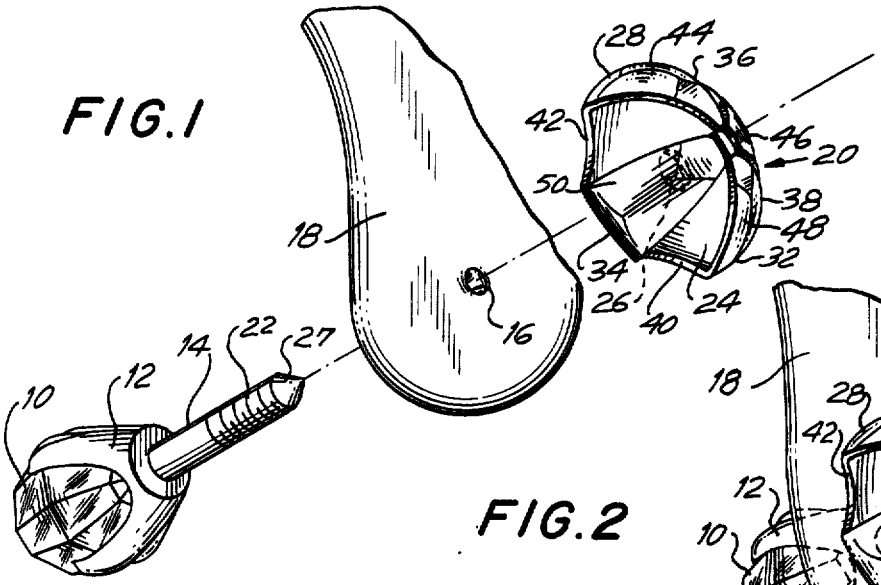
FIG.2
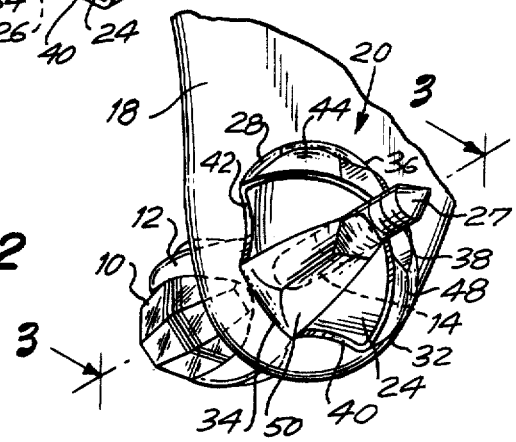
FIG.3
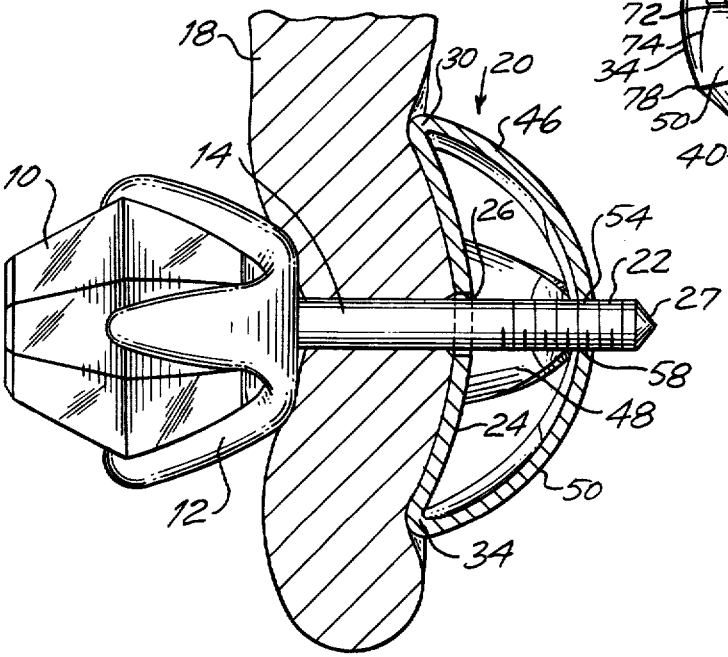
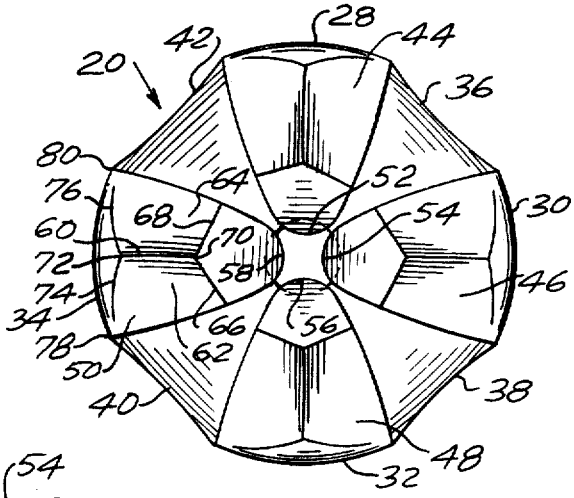
FIG.4

EARRING

CROSS-REFERENCE TO RELATED APPLICATIONS

The present application is a continuation-in-part of U.S. patent application Ser. No. 908,059 filed May 22, 1978 now U.S. Pat. No. 4,170,118 and now allowed, and U.S. patent application Ser. No. 032,652 filed Apr. 23, 1979.

BACKGROUND OF THE INVENTION

1. Field of the Invention

A post-type earring for pierced ears.

2. Description of the Prior Art

Earrings have been worn by women for purposes of adornment and as jewelry ever since the earliest civilizations. Earrings or other appurtenances for mounting to the earlobe have been found in numerous archeological excavations, and to this day even primitive societies such as the eskimos or the natives in jungles or on isolated south seas islands have adopted ornaments for the ears. The purpose of earrings is primarily for the decoration of the individual, and earrings together with a suitable matching necklace provide a pleasing appearance and heighten the attractiveness of the individual. Thus earrings, albeit not having any utilitarian function, are an important article of the jewelry trade and are a significant article of commerce and manufacture.

There are two kinds of earrings that are used for pierced ears, which are ears in which the earlobe has been pierced to provide a permanent passage for the insertion of a linear member, which is thus threaded through the earlobe. One is the so-called "wire" earring. The other is the so-called "post" earring. In a wire earring, the dangling ornament is provided with a U-shaped thin wire at one end of the ornament. One branch of the U is connected to the ornament permanently, the other end of the U is threaded through a person's earlobe and then is engaged with a catch of the ornament.

A post earring is connected to an ear by a rigid slender short linear rod or post. One end of the rod is attached to the ornament; the other end of the rod is pushed through the opening in a person's earlobe, and then a friction nut is slid onto this other end. This nut has a central opening defined by the tips of a plurality of resilient fingers. The fingers frictionally engage on the rod or post. The friction nut slides onto the post easily and slides off with difficulty. The problem with this type of prior art earring is that the friction nuts can become displaced accidentally, for instance, while the person is engaged in physical exertion or sleeping. Other types of post earrings have a threaded post, or a post in which at least the end opposite to the setting in which the ornament is mounted is threaded, in combination with a nut such as a wingnut or the like. The nut is screwed onto the post to hold the earring in place on the earlobe, and subsequent removal of the earring is accomplished by screwing off the nut followed by pulling the post out of the opening in the earlobe.

Among the prior art on earrings may be mentioned U.S. Pat. Nos. 298,987; 335,100; 439,457; 733,263; 2,373,002; 2,713,863; 2,882,702; 3,563,056 and Swiss Pat. No. 295,468.

SUMMARY OF THE INVENTION

1. Purposes of the Invention

It is an object of the present invention to provide an improved earring.

Another object is to provide an improved post-type earring.

A further object is to provide post-type earring in which the friction nut or clutch is pushed on and screwed off.

An additional object is to provide a post-type earring in which the clutch is self-locating onto the post.

Still another object is to provide a post-type earring in which the clutch is mounted on the post by a ratchet-like movement but must be screwed off for removal from the post.

Still a further object is to provide a post-type earring in which the clutch is shaped to provide a stronger ratchet and better ratchet effect.

Still an additional object is to provide a post-type earring in which the hole in the rear clutch is self-locating so that a woman emplacing the earring is assisted in getting the post into the hole.

An object is to provide a post-type earring in which the post is cammed into the hole in the clutch.

An object is to provide an earring which cannot be dislodged by strenuous physical activity or the like, but only by screwing the clutch or friction nut off of the post.

An object is to provide an earring in which the clutch is readily emplaced on the post and yet is not easily accidentally dislodged when once emplaced, and is only removable by the positive and conscious effort of screwing the clutch off of the post.

An object is to provide an earring having a concave base in the clutch for self-locating of the post.

An object is to provide an earring having a clutch with a base having a configuration which facilitates grip and unscrewing, e.g. an octagonal base.

An object is to provide an earring having a clutch with fingers having convex and rounded tips to provide improved coaction between the fingers of the clutch and the threaded post.

An object is to provide an earring having a clutch with fingers having integral ridges for increased strength, less weight and improved flexibility.

An object is to provide an earring having a clutch which may be readily stamped out or otherwise formed from metal sheet, and which thus is capable of being produced in low cost mass production facilities using unskilled labor.

These and other objects and advantages of the present invention will become evident from the description which follows.

2. Brief Description of the Invention

The present earring post differs from a conventional post in that instead of a smooth post, a post is provided with a threaded helix, and also in that instead of the usual friction clutch, a clutch is provided with springy fingers. When this clutch is pushed on to the post, it can slide smoothly in an engaging direction, there being a ratchet-like passage of the tips of the fingers over the crests of the convolutions of the threads. However, the fingers cannot be moved reversely in an axial direction, because in an axial direction they catch on the flanks of the threads. To remove the springy fingers and thereby release the post, the fingers have to be rotated about the post. Thus the present concept entails an axial push type engagement of the clutch, with rotary disengagement. In other words, where the conventional post was smooth, the new post is formed with a helical rib, i.e. a thread. The new post is used in the same way as the old one, that is to say, it is pushed through a person's ear and then a friction nut is pushed on to it. However, the nut cannot be pulled off, because the thread is too great an impediment to axial removal of the nut. Instead, it must be screwed off.

To summarize, the present earring for pierced ears includes an ornament in a setting, a rectilinear cylindrical post which extends from the ornament setting, and a clutch. At least a portion of the outer surface of the post has a helical threading.

All of the elements or parts of the clutch have a generally uniform and equal thickness, thus the clutch may be formed by stamping from a sheet of metal of uniform thickness. The clutch is of generally conical configuration, and has a central concave base portion which has a central circular opening and an outer perimeter defined by a plurality of alternate outwardly curving and inwardly curving arc portions aligned along a circumference.

The clutch is also provided with a plurality of spaced-apart curved springy fingers of specific configuration. The curved springy fingers extend radially from rounded convex terminal tips which define a generally circular opening, to a curved attachment to the generally circular outer perimeter of the base portion. Each of the curved attachments are at and co-extensive with one of the outwardly curving arc portions, so that, as mentioned supra, the clutch is generally conical. Each of the fingers has a central longitudinal ridge along at least a portion of the length of the finger, so that each finger has two opposed lateral faces which are not coplanar but instead are at an obtuse angle to each other.

The clutch is engageable by the post by extending the post axially through the central opening in the base portion, and then through the opening defined by the rounded terminal tips of the fingers. This latter disposition causes the tips of the fingers to pass over the convolutions of the threading of the post, so that the clutch cannot be disengaged from the post by reverse axial movement, but may be disengaged from the post only by rotating the clutch to slide the tips of the fingers along in the channels or grooves of the convolutions of the helical threading of the post, whereby the clutch is unscrewed off of the post. The circular central opening and the generally circular perimeter of the base portion of the clutch are coaxial and concentric, but are spaced apart and not coplanar. The circular central opening defined by the rounded terminal tips of the fingers is coaxial with the central circular opening in the base portion of the clutch.

Typically in a preferred embodiment, all of the arc portions are generally of the same length; however, the outwardly curving arc portions may all be of the same length which is different from the common length of all of the inwardly curving arc portions.

An important aspect of the invention is the specific preferred configurations of the ridges or partial folds of the fingers. In one embodiment, the central longitudinal ridge of each finger terminates short of the rounded terminal tip of the finger, and two opposed lateral ridges extend angularly from the terminus of the central ridge to the side edges of the finger. Generally these lateral ridges will be rectilinear. In another aspect of the invention, the central longitudinal ridge of each finger preferably terminates short of the respective outwardly curving arc portion of the outer perimeter of the base portion of the clutch, and two opposed lateral ridges extend angularly from the terminus of the central ridge towards the ends of the respective outwardly curving arc portion. In this case, it is generally preferred that the lateral ridges terminate short of the ends of the respective outwardly curving arc portion, and that the lateral ridges be curved. These ridge configurations accommodate for flexing of the fingers as the clutch is slid on and screwed off of the post.

Typically the number of fingers will be at least four, and when four fingers are provided, the perimeter of the base of the clutch will be octagonal, i.e. with four corresponding outwardly curving arc portions, each alternating with an inwardly curving arc portion which extend between successive or juxtaposed fingers.

The present invention provides several salient advantages. The present improved post-type earring features a clutch which is pushed on and screwed off, thus an improved earring fastening means is provided which is readily mounted on the post, yet is secure and not removable except by screwing off. Thus, the clutch is mou nted on the post by a ratchet-like movement, but must be screwed off for removal from the post. The clutch is self-locating onto the post, because of the configuration of the disc-shaped concave central base member and especially the fingers, which provide a cup-like concave recess for ingress of the post. The clutch is shaped to provide a stronger ratchet and a better ratchet effect. The first hole in the rear or back clutch is self-locating due to the concavity of the base, so that a woman emplacing the earring is assisted in getting the post into the first hole, i.e. the post is cammed into the first hole in the clutch. The present earring when once emplaced cannot be dislodged by strenuous physical activity or the like, but only when the clutch or friction nut is screwed off. Thus, an advantage is that the clutch is readily emplaced on the post simply by pushing it onto the post, and yet the clutch cannot be accidentally dislodged when once emplaced, and is only removable by the positive and conscious effort of screwing the clutch off the post.

Other advantageous aspects of the invention are that the concave base in the clutch provides for and facilitates self-locating of the post, and that the perimeter of the base, which is preferably octagonal, has a configuration which facilitates grip and unscrewing. Since the clutch has fingers with convex rounded tips, improved coaction between the fingers of the clutch and the threading of the post is provided and attained, as mentioned supra. The integral ridges on the fingers provide increased strength, less weight and improved flexibility and springiness. Since the clutch may be simply formed by stamping from a metal sheet of uniform thickness, the clutch is capable of being mass produced at low cost in facilities using unskilled labor.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention:

FIG. 1 is an exploded perspective view of the present earring;

FIG. 2 is a perspective view of the earring as emplaced on an earlobe;

FIG. 3 is a sectional elevation view taken substantially along the line 3—3 of FIG. 2; and FIG. 4 is a plan view of the clutch per se.

DETAILED DESCRIPTION OF THE PREFERRED EMBODIMENTS

Referring now to the Figures, the present earring for pierced ears includes an ornament 10 in a setting 12, and a rectilinear cylindrical post 14 which extends from the setting 12. To emplace the earring, the post 14 is extended through an opening 16 in an earlobe 18, and a clutch of the present configuration and designated generally as 20 is mounted on the post 14, as shown in FIG. 2. End portion 22 of the outer surface of the post 14 is provided with a helical threading to receive the tips of the fingers of the clutch 20, as will appear infra.

As best seen in FIG. 3, all of the elements of the clutch 20 have a generally uniform and equal thickness, so that the clutch may be stamped or otherwise formed from sheet metal. The clutch 20 has a central concave base portion 24, which has a circular central opening 26.

The concave configuration of the base portion 24 serves to effectively cam the post 14 so that the tip end 27 of the post 14 easily finds the hole 26 and thus the post 14 may readily be threaded through the hole 26.

The clutch 20 has an outer perimeter defined by four outwardly curving arc portions 28, 30, 32 and 34 and four inwardly curving arc portions 36, 38, 40 and 42. These outwardly and inwardly curving arc portions alternate around the perimeter of the concave base portion 24, so as best seen in FIG. 4 the arc portions are aligned along and around the circumference of the clutch 20 at the perimeter of the base portion 24. This octagonal base perimeter, as best shown in FIG. 4, facilitates the gripping and unscrewing of the clutch 20. FIG. 4 also illustrates a preferred dimensional configuration in which all of the arc portions are of generally the same length.

The clutch 20 is completed by the provision of four spaced apart curved springy fingers 44, 46, 48 and 50, which extend radially from respective rounded convex terminal tips 52, 54, 56, 58. The tips serve to define a circular opening through which the threaded post portion 22 is extended. Each finger extends from its respective rounded terminal tip to a curved attachment to the generally circular outer perimeter of the base portion 24, e.g. the finger 50 is attached at 30, so that each of the curved attachments is at one of the outwardly curving arc portions. Thus, the clutch 20 is generally conical.

All of the fingers are of generally identical size, shape and configuration, the fingers being spaced apart equally and symmetrically to provide the conical outline to the clutch 20. Each of the fingers has a central longitudinal ridge along a middle portion of the length of the finger, e.g. the finger 50 is provided with a central longitudinal ridge 60. Thus each finger has two opposed lateral faces which are not coplanar, e.g. the finger 50 has lateral faces 62 and 64. This structural aspect of ridge 60 and opposed faces 62 and 64 provides increased strength to the finger 50 with less overall weight or thickness of the clutch.

The clutch 20 is engaged by the post 14 after initially threading the post 14 through the opening 16 in the earlobe 18. Then, the clutch 20 is engaged by the post 14, and vice versa, by extending the post 14 axially through the central opening 26 in the base portion 24, and then through the opening defined by the rounded terminal tips 52, 54, 56 and 58 of the curved springy fingers. Thus, the tips of the fingers pass over the convolutions of the threading, and the clutch 20 cannot be disengaged from the post 14 by reverse axial movement, but may be disengaged from the post 14 only by rotating the clutch 20 to slide the tips 52, 54, 56 and 58 along the convolutions of the helical threading 22. In this manner, the clutch 20 is unscrewed off of the post 14.

The circular central opening 26 in the base portion 24, and the generally circular perimeter of the base portion 24, which is defined by the alternate arc portions 28, 36, 30, 38, 32, 40, 34 and 42, are coaxial and concentric but spaced apart in parallel planes. The circular central opening defined by the finger tips 52, 54, 56 and 58 is coaxial with the circular central opening 26 in the base portion 24, as best seen in FIG. 4.

FIG. 4 also shows a preferred embodiment and best mode of practicing the invention, in which the central longitudinal ridge 60 of finger 50 terminates short of the rounded terminal tip 58, and two opposed lateral typically rectilinear ridges 66, 68 extend angularly from the terminus 70 of the central ridge 60 to the side edges of the finger 50. These lateral ridges 66 and 68 serve to prevent degradation or bending of the finger tip 58 as well as to improve flexibility of the finger 50.

In another preferred embodiment of the invention, as best shown in FIG. 4, the central longitudinal ridge of the finger 50 terminates short of the outwardly curving arc portion 34 of the outer perimeter of the base portion 24 of the clutch 20, at a terminus 72, and two opposed lateral ridges 74, 76 extend angularly from the terminus 72 towards the ends of the outwardly curving arc portion 34. Preferably, the lateral ridges 74, 76 are curved as shown and terminate short of the ends 78, 80 of the outwardly curving arc portion 34. The purpose and function of the lateral ridges 74, 76 is to improve flexibility of the finger 50 while providing greater strength and resilience.

It thus will be seen that there is provided an earring which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An earring for pierced ears which comprises an ornament in a setting, a rectilinear cylindrical post extending from said ornament setting, at least a portion of the outer surface of said post having a helical threading, and a clutch, all of the elements of said clutch having a substantially uniform and equal thickness, said clutch having a central concave base portion having a circular central opening and an outer perimeter defined by a plurality of alternate outwardly curving and inwardly curving arc portions aligned along a circumference, and a plurality of spaced-apart curved springy fingers, said curved springy fingers extending radially from rounded convex terminal tips defining a circular opening, to a curved attachment to the substantially circular outer perimeter of said base portion, each of said curved attachments being at one of said outwardly curving arc portions, so that said clutch is substantially conical, each of said fingers having a central longitudinal ridge along at least a portion of the length of the finger, so that each finger has two opposed lateral faces which are not coplanar, said clutch being engageable by said post by extending said post axially through the central opening in said base portion and then through the opening defined by the rounded terminal tips of said fingers, whereby the tips of said fingers pass over the convolutions of the threading, and so that said clutch cannot be disengaged from said post by reverse axial movement but may be disengaged from said post only by rotating said clutch to slide the tips of said fingers along the convolutions of the helical threading of said post, whereby said clutch is unscrewed off of said post, the circular central opening and the substantially circular perimeter of the base portion of said clutch being concentric, and the circular central opening defined by the rounded terminal tips of said fingers being coaxial with the circular central opening of the base portion of said clutch.

2. The earring of claim 1 in which all of the arc portions are of substantially the same length.

3. The earring of claim 1 in which the central longitudinal ridge of each finger terminates short of the rounded terminal tip of the finger, and two opposed lateral ridges extend angularly from the terminus of the central ridge to the side edges of the finger.

4. The earring of claim 3 in which the lateral ridges are rectilinear.

5. The earring of claim 1 in which the central longitudinal ridge of each finger terminates short of the respective outwardly curving arc portion of the outer perimeter of the base portion of the clutch, and two opposed lateral ridges extend angularly from the terminus of the central ridge towards the ends of the respective outwardly curving arc portion.

6. The earring of claim 5 in which the lateral ridges terminate short of the ends of the respective outwardly curving arc portion.

7. The earring of claim 5 in which the lateral ridges are curved.

8. The earring of claim 1 in which the number of fingers is four and the perimeter of the base of the clutch is octagonal.

* * * * *